US008167276B2

(12) United States Patent
Esposito

(10) Patent No.: US 8,167,276 B2
(45) **Date of Patent: *May 1, 2012**

(54) FENCE SYSTEM WITH INSECT BARRIER

(75) Inventor: Rosario Esposito, Shelby Township, MI (US)

(73) Assignee: Royal Aluminum & Steel, Inc., Chesterfield Township, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/950,800

(22) Filed: Nov. 19, 2010

(65) Prior Publication Data

US 2011/0147688 A1 Jun. 23, 2011

Related U.S. Application Data

(63) Continuation of application No. 12/128,317, filed on Aug. 12, 2008, now Pat. No. 7,857,292, which is a continuation of application No. 10/971,989, filed on Oct. 22, 2004, now abandoned.

(51) Int. Cl.
*E04H 17/14* (2006.01)

(52) U.S. Cl. ..... 256/65.11; 256/22

(58) Field of Classification Search ..... 256/21, 256/22, 59, 65.11, 65.02, 65.09
See application file for complete search history.

(56) References Cited

U.S. PATENT DOCUMENTS

| | | | | |
|---|---|---|---|---|
| 247,537 | A * | 9/1881 | Connelly | 256/8 |
| 2,574,711 | A * | 11/1951 | Rose | 256/19 |
| 4,014,520 | A | 3/1977 | Walters | |
| 4,145,031 | A | 3/1979 | Baker, II | |
| 4,188,019 | A | 2/1980 | Meredith | |
| 4,498,660 | A | 2/1985 | Brema et al. | |
| 4,609,185 | A | 9/1986 | Prater et al. | |
| 4,898,365 | A | 2/1990 | Conner et al. | |
| 5,454,548 | A | 10/1995 | Moore | |
| 5,651,534 | A | 7/1997 | Yoder | |
| 5,713,171 | A | 2/1998 | Andres | |
| 6,299,142 | B1 | 10/2001 | Chaney et al. | |
| 6,305,671 | B1 | 10/2001 | Valentine | |
| 6,345,809 | B1 | 2/2002 | Bebendorf et al. | |
| 6,523,807 | B2 | 2/2003 | Calverley | |
| 6,588,733 | B1 * | 7/2003 | Tremeer et al. | 256/19 |
| 6,994,326 | B1 * | 2/2006 | Tyson | 256/1 |
| 2006/0266989 | A1 * | 11/2006 | Masterson | 256/65.01 |
| 2007/0200105 | A1 * | 8/2007 | Williams | 256/22 |
| 2007/0221902 | A1 * | 9/2007 | Kerr | 256/22 |

* cited by examiner

*Primary Examiner* — Joshua Kennedy
(74) *Attorney, Agent, or Firm* — Douglas P. LaLone; Rader Fishman & Grauer PLLC

(57) ABSTRACT

A fence system including a fence post and a rail inserted into and supported by the fence post. The rail being an elongated member having a channel or U-shaped cross section defined by a web member and parallel leg members attached to the web member. The rail is inserted into an aperture located in a sidewall of the post. The aperture having a shape or configuration that is substantially the same as the cross-sectional shape of the rail. Accordingly, any gaps between the opening or aperture in the post and the rail, once the rail is inserted into the post, are minimized.

32 Claims, 3 Drawing Sheets

FENCE SYSTEM WITH INSECT BARRIER

CROSS-REFERENCE TO RELATED APPLICATIONS

This Application is a Continuation of application Ser. No. 12/128,317 filed on Aug. 8, 2008 now U.S. Pat. No. 7,857,292 which is a Continuation of application Ser. No. 10/971,989 filed on Oct. 22, 2004 now abandoned.

BACKGROUND OF THE INVENTION

1. Field of the Invention

The present invention relates generally to a rail type fence system including a fence post and rails. More specifically, the invention is directed to a rail type fence system having a configuration that limits access to the interior of the fence post and rail components to prevent formation of insect nests.

2. Description of Related Art

Fences are almost as old as humanity. Over the years, fences of all types and kinds, from rock walls to barbed wire, were built with one of two purposes in mind, keep things in or keep them out. For instance, fences are used to keep livestock in a certain area or are placed around a particular area to prevent access thereto. Today, fences also provide a decorative touch or provide privacy.

One of the more common fence systems presently used is a fence post and rail combination, wherein the fence posts are placed at spaced intervals. Horizontal rails are placed between the fence posts. One example of a fence post and rail combination is the standard split rail fence seen throughout much of rural America typically used to contain livestock. In many instances, attached to the rails are fence elements or pickets forming what we refer to today as a picket fence.

Like many of our products today, fences are manufactured and sold as a component system, including a plurality of preformed fence posts as well as a plurality of rails designed to fit, connect, or interlock to the fence posts. Typically, these fence systems utilize a tubular fence posts made of metal or plastic having a plurality of shaped apertures located in the sidewalls thereof to receive the rails, including appropriate hardware to interlock the components together.

One example of such a fence system is illustrated in U.S. Pat. No. 5,651,534 to Yoder. Yoder teaches a plurality of hollow, extruded fence posts as well as a number of hollow, extruded fence rails. A pair of rectangular shaped openings located on opposed walls of the fence posts receive the rails of the fence system. As shown in Yoder, the rails have a rectangular shape with a closed cross section. Thus, the rails fit securely within the rectangular shaped apertures in the fence posts without leaving any appreciable gaps. A cap closes the upper end of the fence post and further prevents access to the hollow interior thereof.

Another example of a fence system is disclosed in U.S. Pat. No. 4,609,185 to Prater et al. Prater et al. discloses a fence post and rail configuration including tubular fence posts containing a plurality of apertures in the sidewalls thereof for receiving the rails. The rails are formed with a generally channel or U-shaped cross section formed of a web and sidewalls extending there from. Accordingly, when the rail is inserted into the tubular fence post, a gap or opening exists that extends between the lower edge or sides of the rectangular shaped aperture and the web of the rail. This gap or opening provides access to the interior of the hollow fence post.

One drawback of such a modular fence design using a rail having a channel or U-shaped cross section is that insects, particularly bees or hornets have access to the interior of the hollow fence post and often build nests within the fence posts. This can be very problematic, especially when such fence systems are used around homes and recreation areas, particularly pools and playgrounds.

Accordingly, in an attempt to reduce the possibility of insect infestation, including the opportunity for insects to build nests within the hollow fence post, it is desirable to reduce the opportunity for insects to have access to the hollow interior of the fence posts by somehow closing the gap or opening.

FIGS. 4-5 illustrate a prior art design for closing the gap or opening. Specifically, a plurality of preformed plugs are inserted into the channel or U-shaped rail, between the sidewalls and up to the web member thereof. The plugs operate to form a seal that reduces access to the interior of the fence post. The plugs are formed in accordance with the specific size and configuration of the rail. Thus, a stock of variably sized plugs is necessary depending upon the design and parameters of the fence system. In addition, the cost of manufacturing and storing the plugs can make such a system too expensive for all but very small uses. Further, it should be taken into account that inserting a plug in each rail at every fence post and rail junction is a time-consuming and laborious procedure, which, for large amounts of fencing, can be cost prohibitive.

From the above, it can be appreciated that modular fence systems are not fully optimized to provide a simpler, less costly fence system that reduces the opportunity for insect infestation in the fence components, particularly the fence posts. Therefore, what is needed is a fence post and rail system that fits together without any appreciable gap or opening between the fence post and rail and thereby reduces the opportunity for insect infestation within the fence post.

BRIEF SUMMARY OF THE INVENTION

According to the preferred embodiment of the present invention, there is provided a fence system including a fence post and a rail for insertion into an aperture in the fence post. The rail has a channel or U-shaped cross section that results in one side being open. The aperture in the fence post is configured similar to the cross section of the rail and includes an upstanding portion or tab. The upstanding portion or tab is sized such that it fits within the channel or interior of the U-shaped cross section to block access to the interior of the fence post. Thus, the present invention is capable of successfully incorporating the benefits of a fence system with an integrated insect barrier without the need for additional plugs or stop members.

It is an object of the present invention to provide a fence system for use with rails having generally a channel or U-shaped cross section. The fence post includes an aperture having an upstanding portion or tab that fits within the channel. Wherein the rails fit snugly into the aperture in the fence post to block access to the interior of the fence post and prevent insect infestation, including the creation of nests within the interior of the fence post.

It is a further object of the present invention to provide a fence system including fence posts and rails, wherein the fence post includes an aperture for receiving the rail. The aperture in the fence post for receiving the rail corresponds to the shape or configuration of the cross section of the rail such that the rail fits securely within the fence post without any appreciable gaps or openings that would allow for possible insect infestation within the hollow area of the fence post.

These objects and other features, aspects and advantages of this invention will be more apparent after a reading of the following detailed description, appended claims and accompanying drawings.

DETAILED DESCRIPTION OF THE PREFERRED EMBODIMENT

Figure 4:
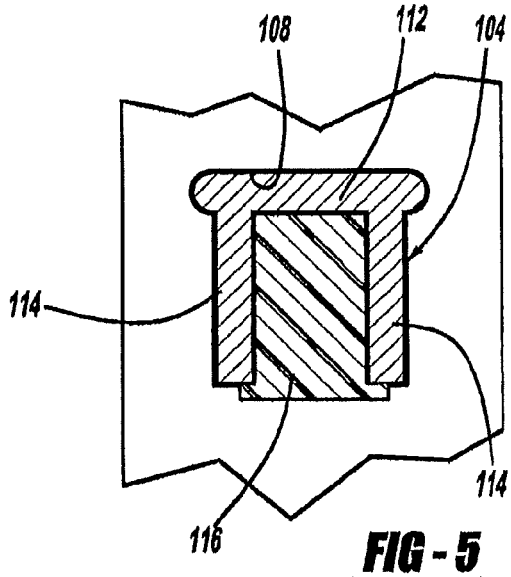
FIG - 4 Prior Art
FIG. 4 is a partial side view of a prior art fence system utilizing a plug placed within the channel of the rail.
Figure 5:
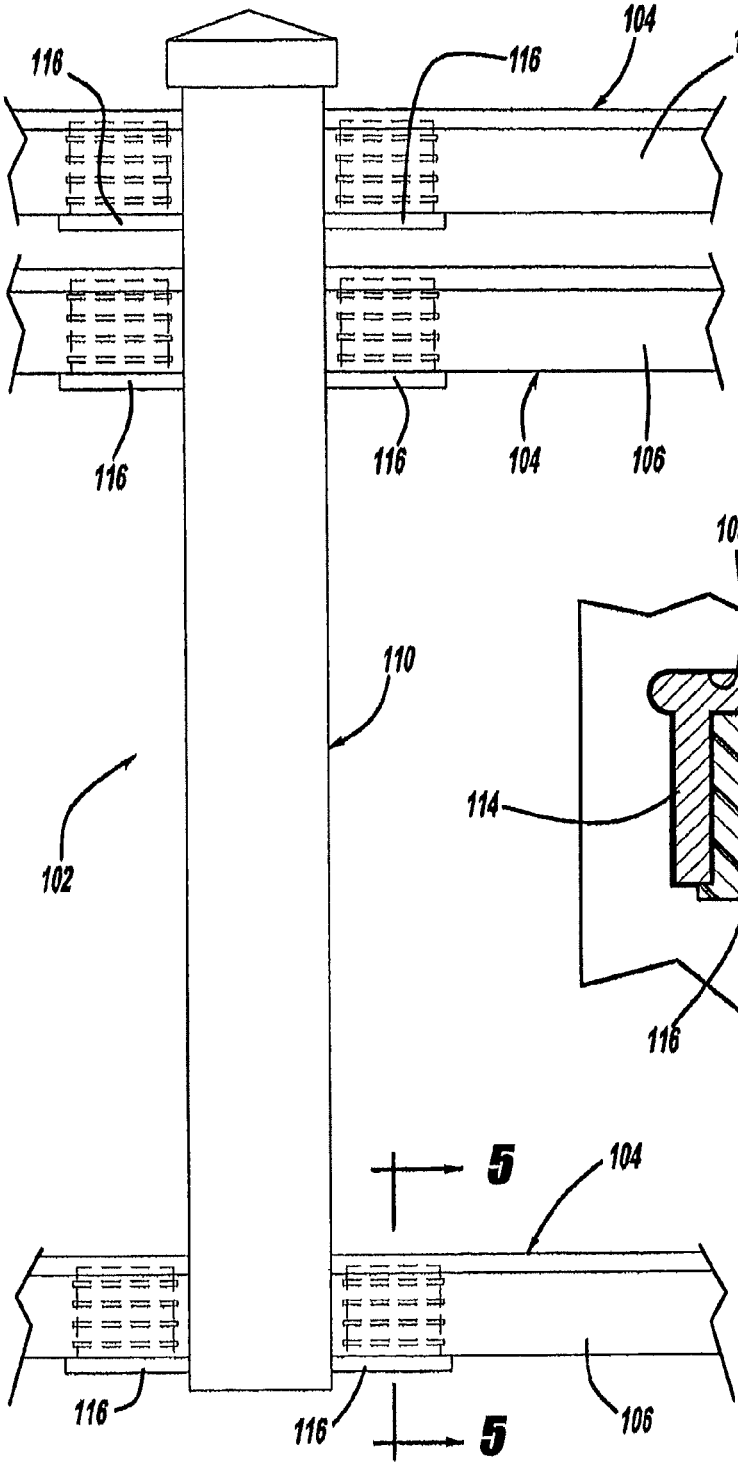
FIG - 5 Prior Art
FIG. 5 is a cross-sectional view of the prior art fence system taken along lines 5-5 of FIG. 4.

As discussed above, FIGS. 4-5 illustrate a prior art fence systems 102 that utilizes a rail 104 having a substantially U-shaped cross section 106. The rail 104 is inserted into an aperture 108 located in a hollow fence post 110. The aperture 108 is typically a rectangular or square opening of a size suitable to accept the three sides of the U-shaped rail 104, specifically, the web 112 and two legs or sides 114 of the U-shaped cross section. Therefore, this type of fence system 102 inherently has a problem in that it provides a gap or opening that allows access to the interior of the fence post 110.

In an attempt to solve this problem, plugs 116 sized to fit between the leg or sides 114 of the U-shaped rail 104 are inserted adjacent the fence post 110. Use of the plug 116, while closing the gap or opening, creates additional costs associated with both manufacturing the plugs 116 and the labor to insert the plugs 116 at each and every joint between the fence post 110 and rail 104. Since this plug is inserted using only an interference fit, it is unknown at this time, whether exposure to the elements, over time, will work its way loose and expose the gap or opening in the rail.

Figure 1:
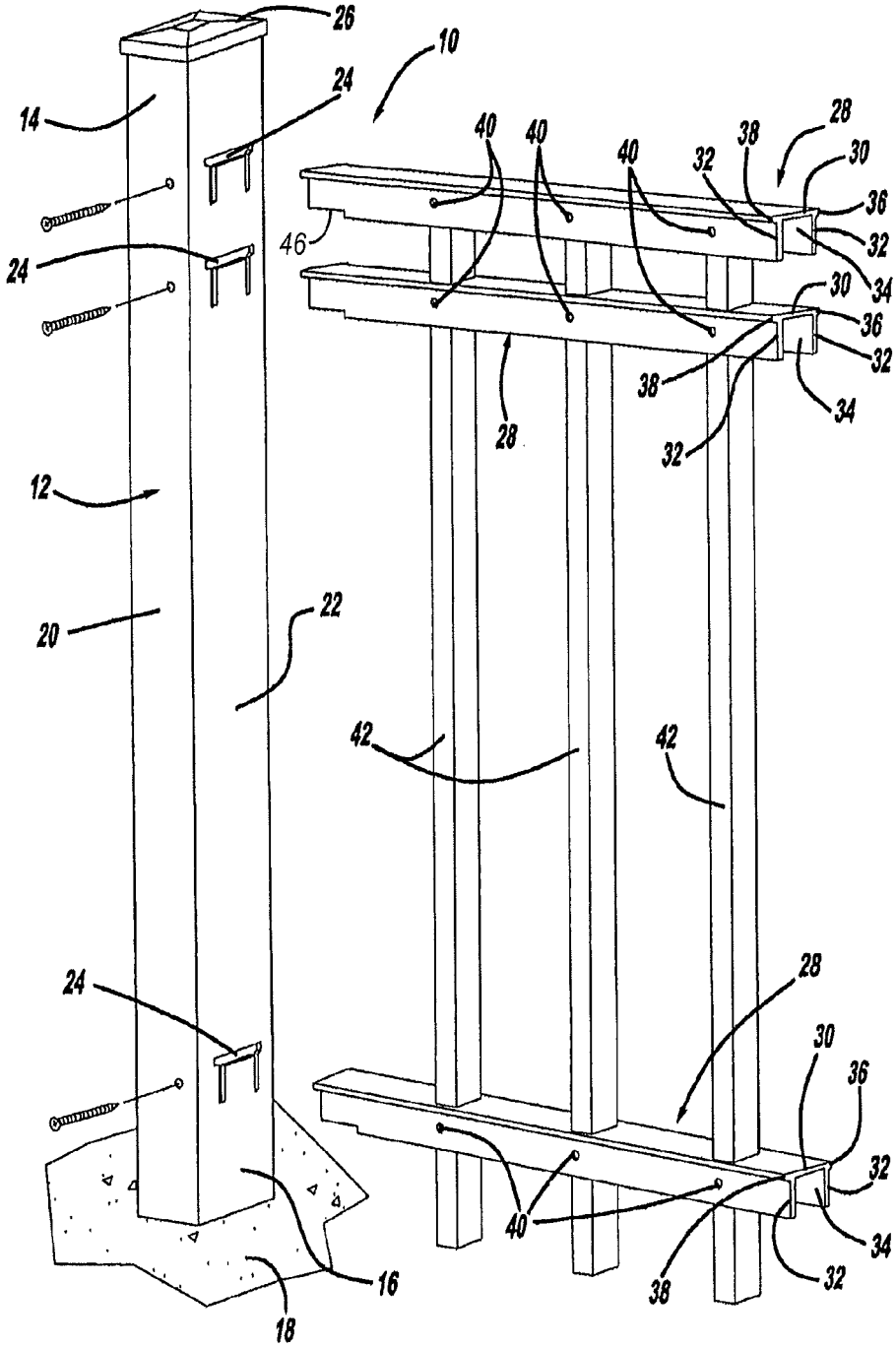
FIG. 1 is an exploded perspective view of a fence system according to the preferred embodiment of the present invention.

Referring now to FIG. 1, there is shown a perspective view of a modular fence system 10 according to an embodiment of the present invention. The modular fence system 10 [in] includes a fence post 12. The fence post 12, has a cavity and includes an upper end 14 and a lower end 16 that is embedded in the ground 18 using well known prior art teachings for anchoring the post. The fence post 12 is hollow or tubular and includes a front sidewall 20 and a right sidewall 22. It should be understood that the fence post 12 shown in the present invention has a square configuration or cross section and thus includes a rear and left sidewall that is not shown in the drawings. As the fence post 12 is hollow or tubular, each of the front and right sidewalls 20, 22, along with the rear and left sidewalls (not shown) will have interior and exterior surfaces. It should also be understood that although the preferred embodiment describes a square post, other geometric configurations for the post are contemplated in practicing the invention as described herein.

The fence post 12 shown in FIG. 1 is used as an end post and includes three apertures 24 located in the right sidewall 22. If the fence post 12 were to be used as an in-line post it would include additional openings or apertures 24 formed in the left sidewall. If used as a corner post, additional openings or apertures 24 are formed in either the front 20 or rear sidewall depending upon the particular corner formed by the fence post 12. While shown with three openings or apertures 24, the fence post 12 according to the present invention may include a lesser or greater number of openings or apertures 24 depending upon the amount or number of rails 28 forming the fence assembly or system 10. A cap 26 is placed on the upper end 14 of the fence post 12 to cover the upper or open end 14 thereof.

The modular fence system 10 further includes a rail 28. The rail 28 is an elongated substantially U-shaped channel member having an end or web member 30 and side flange members 32 extending substantially perpendicular from the end or web member 30. The side flange members 32 define a gap or opening 34 there between. As shown herein, the edges 36, 38 of the end or web member 30 are rounded and extend slightly past the side flange members 32. The rail 28 further includes a plurality of apertures 40 located in the respective side flange members 32.

As shown in FIG. 1 a plurality of fence elements or pickets 42 are fastened to the rails 28. The fence elements or pickets 42 extend up to or through the end or web member 30, and are fastened to the rail 28 by fasteners extending through the apertures 40 located in the side flange members 32 of the rails 28. The rails 28 have a notched portion 46 that provides a stop for the rail 28 as it enters the opening 24 of the post 12. Once the rail 28 is inserted into the opening 24, a seal is created. The number of fence elements or pickets 42 along with the placement or spacing thereof is a design choice. The invention set forth herein is suitable for use with out fence elements or pickets 42 extending between the respective rails 28.

Figure 2:
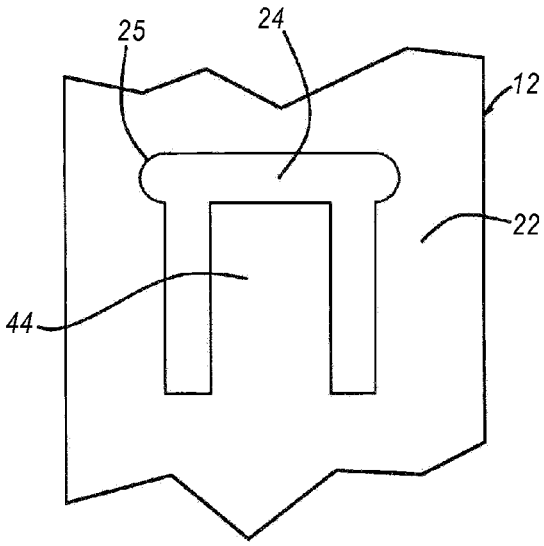
FIG. 2 is a partial side view of the fence post of FIG. 1 illustrating an aperture configured in accordance with the present invention.
Figure 3:
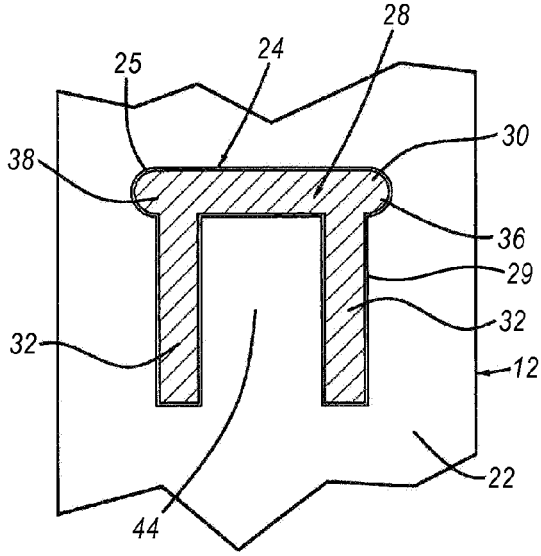
FIG. 3 is a partial, cross-sectional side view of the fence post of FIG. 1 illustrating a rail having a substantially U-shaped cross section disposed within the aperture in accordance with the present invention.

Turning now to FIG. 2 there is shown the aperture or opening 24 in the post in detail. Specifically, an upstanding portion or tab 44 extends upwardly into the aperture or opening 24. The upstanding portion or tab 44 has a shape or configuration complementary to the shape or configuration of the gap or opening 34 located between the respective side flange members 32 of the rail 28. The upstanding portion or tab 44 has a length substantially equal to the length of the respective side flange members 32 such that it ends in close proximity to the end or web member 30 of the rail 28. It will be apparent that the configuration or shape of the opening or aperture 24 is substantially the same as a cross-sectional shape of the inner configuration of the U-shaped channel of the rail 28. Accordingly, as shown in FIG. 3 when the rail 28, shown in cross-section, is inserted into the opening or aperture 24, it fits such that there is no significant gap or opening between the outer periphery of the rail and the inner periphery of the aperture 24 in the post to allow access to the interior of the fence post 12. As shown in FIG. 3, the peripheral edge 25 of the opening or aperture 24 substantially corresponds with the outer configuration of the rail 28 to create a seal 29 to prevent access by insects and thereby avoid insect infestation within the hollow interior of the fence post 12. The outer configuration, cross-section, or profile of the rail 28 is slightly smaller than the peripheral edge 25 of the aperture 24. No insects can pass between the outer profile of the rail 28 and the aperture 24. This creates a sealed fence system. Insects cannot enter the cavity of the hollow post 12, thus creating an insect free fence system.

It should be understood that the present invention provides an aperture or opening 24 that substantially corresponds to both the outer configuration or shape of the rail 28 and the inner configuration or shape of the rail 28. That is, the shape of the aperture or opening 24 substantially corresponds to the cross-section of the rail 28. Accordingly, the rail 28 is shown herein as having a substantially U-shaped cross-section with a gap or opening 34 formed by the side flange members 32 of the rail 28. Correspondingly, the aperture or opening 24 of the post 12 includes having an upstanding portion or tab 44 extending upward into the aperture 24. The upstanding portion or tab 44 is sized to fit within the gap or opening 34.

Figure 6:
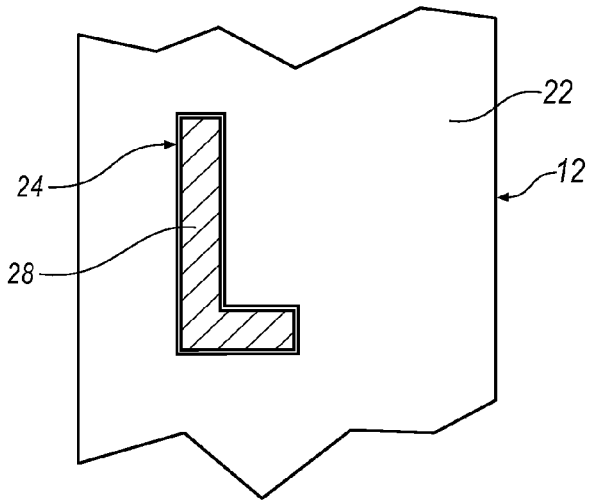
FIG. 6 is a partial cross-sectional view similar to FIG. 3 but illustrating an alternate rail having a substantially L-shaped cross-section and an alternate fence post having an aperture having the same configuration or profile as the cross-section of the rail.

Other configurations, such as a concave polygon shape can be used as long as the aperture or opening 24 has a corresponding concave polygon shape such that any gap existing between the aperture or opening 24 and the rail 28, when the rail 28 is inserted into the post 12 is minimal. Making the gap minimal reduces the opportunity for insects to access the interior of and build nests within the interior of the post 12. For example, as shown in FIG. 6, if the rail 28 had an L shape or angle configuration or cross-section, then the opening or aperture 24 should have the same configuration.

According to the present invention, the opening or apertures 24 in the fence post 12 are stamped or cut into the sidewall, shown in FIG. 1 as the right sidewall 22, of the fence post 12 in a configuration corresponding to the particular cross-section of the rail 28. Doing so provides a snug fit between the rail 28 and the fence post 12 while at the same time limiting access to the interior or hollow portion of the fence post 12. Furthermore, the present invention does not require any additional parts or components in the form of plugs or other parts to reduce the possibility of insect infestation within various components of the fence system 10. In addition, the foregoing invention may be used with other components of a fence system 10. For example, depending upon the shape and configuration of the rails, the fence elements or pickets 42 may be installed in the rails in a similar manner.

While the present invention has been described in terms of a preferred embodiment, it is apparent that other forms could be adopted by one skilled in the art. In other words, the teachings of the present invention encompass any reasonable substitutions or equivalents of claim limitations. Accordingly the scope of the present invention is to be limited only by the following claims.

What is claimed is:

1. A closed fence system comprising:

a post having a hollow cavity and at least one sidewall with an outer surface, said sidewall including a downwardly facing opening defined by a generally horizontal portion with opposing ends, and a pair of vertical portions each extending downwardly and generally perpendicular to the generally horizontal portion to define a generally concave cross-sectional shape, said vertical portions being inwardly offset from the ends of the horizontal portion and extending parallel to one another to define a tab of uniform width extending upwardly into the opening the length of the vertical portions, each vertical portion having a uniform width that extends substantially from top to bottom of each vertical portion, each vertical portion having a uniform width that extends substantially from top to bottom of each vertical portion; and an open fence rail connected to said post, said rail having an exterior profile configured to be received within said opening of said post, said rail having a generally horizontal portion with opposing ends, and a pair of generally vertical portions that are parallel to one another, the vertical portions of the rail being inwardly offset from the ends of the horizontal portion, the generally horizontal portion cooperating with the generally vertical portion to define a generally concave cross-sectional shape complementary to the shape of the opening in the post resulting in a minimal gap between said opening and said rail such that insects are precluded by said rail from entering the opening in said post into said cavity of the post;

wherein the wall of the post supports the weight of the rail.

2. The fence as claimed in claim 1, wherein the post has a second opening in the sidewall having a generally concave cross-sectional profile, said fence further comprising a second fence rail having a generally concave cross-sectional profile similar to the profile of the second opening, said second opening being proportioned to receive said second fence rail such that insects are prevented from entering the hollow cavity of said post through said second opening.

3. The fence as claimed in claim 2, further comprising a plurality of pickets each having a portion proportioned to fit between the generally vertical portions of the rails, at least one of the rails having a plurality of spaced apart apertures in the generally horizontal portion thereof wherein each of the pickets may extend between the generally vertical portions of the at least one of the rails, through one of the apertures in the generally horizontal portion of the at least one of the rails and into the region between the generally vertical portion of the other one of the rails to abut the generally horizontal portion of the other one of the rails.

4. The fence as claimed in claim 1, wherein the generally horizontal portion of the opening is generally flat and the generally horizontal portion of the rail is generally flat.

5. The fence as claimed in claim 1, further comprising a cap on an end of the post wherein once the post, cap and fence rail are assembled, a sealed fence is created precluding insects from entering the cavity.

6. The fence as claimed in claim 1, wherein the fence rail has a notched portion that butts up against the outer surface of said sidewall.

7. The fence as claimed in claim 1, wherein the generally concave cross-sectional shape is selected from a generally polygonal shape, a generally Pi-shape, and a generally U-shaped configuration.

8. A closed fence system comprising:

a post having a hollow cavity and four sidewalls, at least one sidewall having a generally extending downwardly, said U-shaped opening having a first vertical portion, a second vertical portion, and a horizontal portion with opposing ends, said vertical portions being offset inward from the ends of the horizontal portion and extending parallel to one another to define a tab of uniform width extending upwardly into the opening, each vertical portion having a uniform width that extends substantially from top to bottom of each vertical portion, each vertical portion having a uniform width that extends substantially from top to bottom of each vertical portion; and an open fence rail connected to said post, said rail having an exterior profile configured to be received within said opening of said post, said rail having a generally U-shaped cross-section complementary to the profile of the U-shaped opening resulting in a minimal gap between said opening and said rail such that insects are precluded from entering the opening in said post into said hollow cavity of the post.

9. The fence as claimed in claim 8, wherein the fence rail has a notched portion that butts up against the outer surface of said sidewall.

10. The fence as claimed in claim 8, wherein the U-shaped portion is further generally Pi-shaped.

11. The fence as claimed in claim 8, wherein the post has a second opening in the sidewall having a generally U-shaped opening, said fence further comprising a second fence rail having a generally U-shaped external cross-sectional profile similar to the profile of the second opening, said second opening being proportioned to receive said second fence rail such that insects are prevented from entering the hollow cavity of said post through said second opening.

12. The fence as claimed in claim 8, further comprising a plurality of pickets each having a portion proportioned to fit between the generally vertical portions of the rails, at least one of the rails having a plurality of spaced apart apertures in the generally horizontal portion thereof wherein each of the pickets may extend between the generally vertical portions of the at least one of the rails, through one of the apertures in the generally horizontal portion of the at least one of the rails and into the region between the generally vertical portion of the other one of the rails to abut the generally horizontal portion of the other one of the rails.

13. The fence system as claimed in claim 8, comprising:

at least two of said rails;

at least two of said posts, each having at least two of said openings, each of said openings accepting one of said rails; and a plurality of pickets extending between and connecting said first and second rail members.

14. The fence system as claimed in claim 8, further comprising a cap secured to said post, said cap, post and rail members once assembled define a sealed fence system wherein insects cannot penetrate said hollow interior portion of said post.

15. The fence as claimed in claim 8, wherein the post and the rail members are sealed so as to preclude insects from entering the cavity of the post.

16. A sealed fence comprising:

a pair of elongated tubular posts each comprising a tubular member having an entirely hollow cavity, an outer wall and at least one opening in a wall of the post, said opening defining a generally concave internal profile of a predetermined dimension including a generally horizontal portion with opposing ends and a pair of vertical portions extending generally downward from and perpendicular to the horizontal portion, said vertical portions being offset from the ends of the horizontal portion and extending parallel to one another to define a tab of uniform width extending upwardly into the opening, the vertical portions have a uniform width that extends from top to bottom of the vertical portions, the vertical portion has a uniform width that extends substantially from top to bottom of the vertical portion;

a rail member comprising an elongated channel member having a generally concave cross-sectional external profile that is complementary to the generally concave internal profile of the openings in the pair of elongated tubular posts and slightly smaller than the internal profile of the opening, the rail member further having two opposing longitudinal ends, the rail member also having an elongated horizontal portion and at least one elongated flange extending generally perpendicular from the elongated horizontal portion, the horizontal portion and the flange cooperating to define said concave cross-sectional external profile;

said openings in said elongated tubular posts being proportioned to accept one of the opposing longitudinal end of the rail member, the generally horizontal portion of each opening being proportioned to accept the generally horizontal portion of the rail member and the vertical portion of each opening being proportioned to accept the flange of the rail, wherein the space between the rail and opening is so minimal that insects cannot enter said cavity;

wherein the wall of the post supports a portion of the weight of the rail member.

17. The fence as claimed in claim 16, wherein the post and the rail members are further sealed so as to preclude insects from entering the cavity of the post.

18. The fence system as claimed in claim 16, further comprising:

an opening formed in the upper portion of said post; and a cap connected to an upper portion of said post proportioned to close said opening.

19. The fence system as claimed in claim 16 comprising:

at least two of said rails;

at least two of said posts, each having at least two of said openings, each of said opening accepting one of said rails; said walls of said posts cooperating to support the weight of said rails; and a plurality of pickets extending between and connecting said first and second rail members.

20. The fence system as claimed in claim 16, wherein the rail has proximate each longitudinal end a notched portion that butts up against the outer surface of said wall of said post such as to prevent the open fence rail from passing through the opening beyond a predetermined amount during assembly of the open fence rail to the post.

21. The fence as claimed in claim 16, wherein the internal profile of the opening is selected from a generally U-shaped configuration, and a generally Pi-shaped configuration.

22. The fence as claimed in claim 16, wherein the opening comprises two of said vertical portions extending generally perpendicularly from said horizontal portion and the rail comprises two said flanges, each extending generally perpendicularly from said horizontal portion thereof.

23. The fence as claimed in claim 16, further comprising: a channel bounded by the flange and the elongated horizontal portion of the rail, and a plurality of vertical pickets extending into the channel in the rail.

24. A method for providing a closed fence system comprising:

providing a hollow fence post, said post having a wall with an opening of a first generally concave configuration that is oriented in a downward direction, said concave configuration including an opening with a first vertical portion a second vertical portion and an intermediate portion having opposing ends, each of said vertical portions extending downwardly therefrom, each of said vertical portions being offset from said ends and extending parallel to one another to define a tab of uniform width extending upwardly into the opening a length of the vertical portions, said vertical portions include a uniform width that extends substantially from top to bottom of each vertical portion, said vertical portions include a uniform width that extends substantially from top to bottom of each vertical portion;

providing at least one fence rail, said rail having an end portion having a cross-sectional shape of a second generally concave configuration complementary to the first generally concave configuration, and inserting said end of said rail into said opening in said post, said end of said rail being proportioned to fit snugly in said opening such that the space between the end of the rail and the opening is so minimal that insects cannot enter the post.

25. The method as claimed in claim 24, wherein said first concave configuration is selected from a generally concave polygonal configuration, a generally U-shaped configuration, a generally L-shaped configuration, and a generally Pi-shaped configuration.

26. The method as claimed in claim 24, wherein said step of inserting comprises inserting said rail through said opening until a portion of the rail not having said second generally concave configuration abuts said wall.

27. The method as claimed in claim 24, further comprising applying a seal between the rail and the wall of the post to further seal against insects entering the post.

28. The method as claimed in claim 24, further comprising affixing a plurality of vertical pickets to the rail.

29. The method as claimed in claim 24, further comprising:

providing a second opening of the first generally concave configuration in the wall of said post;

providing a second post having two of said openings;

providing two of said fence rails, each having two of said end portions having a cross-sectional shape of said second generally concave configuration similar to the first generally concave configuration, and inserting one end of each of the rails respectively into an opening one of the rails to form a fence system.

30. A closed fence system comprising:

a post having a hollow cavity and four sidewalls, at least one sidewall having at least a generally concave shaped opening, said concave shaped opening is oriented facing downward and includes a first vertical portion, a second vertical portion, and an intermediate portion having opposing ends, the vertical portions extending downwardly and are offset from the ends of the intermediate portion to define a tab of uniform width extending upwardly into the opening the length of the vertical portions, each vertical portion having a uniform width that extends substantially from top to bottom of each vertical portion; and an open fence rail connected to said post, said rail having an exterior profile configured to be received within said opening of said post, said rail having a generally concave shaped cross-section complementary to the profile of the concave shaped opening resulting in a minimal gap between said opening and said rail such that insects are precluded by said rail from entering the opening in said post into said hollow cavity of the post;

wherein the wall of the post supports the weight of the rail.

31. The fence as claimed in claim 30, wherein the fence rail has a notched portion that butts up against the outer surface of said sidewall.

32. The fence system as claimed in claim 30, further comprising:

at least two of said rails;

at least two of said posts, each having at least two of said openings, each of said opening accepting one of said rails; and a plurality of pickets extending between and connecting said first and second rail members.

* * * * *

UNITED STATES PATENT AND TRADEMARK OFFICE

CERTIFICATE OF CORRECTION

PATENT NO. : 8,167,276 B2
APPLICATION NO. : 12/950800
DATED : May 1, 2012
INVENTOR(S) : Rosario Esposito It is certified that error appears in the above-identified patent and that said Letters Patent is hereby corrected as shown below:

At column 6, claim 8, line number 49, after “having a generally”... insert

-- U-shaped opening --.

At column 8, claim 22, line 38, delete “perpendicularly” and insert therefore

--perpendicular --.

Signed and Sealed this
Tenth Day of July, 2012

David J. Kappos

David J. Kappos
*Director of the United States Patent and Trademark Office*